United States Patent [19]

Risse et al.

[11] B 3,981,321

[45] Sept. 21, 1976

[54] VEHICLE FUEL SYSTEM

[75] Inventors: John T. Risse; James C. Taggart, both of Albuquerque, N. Mex.

[73] Assignee: The United States of America as represented by the United States Energy Research and Development Administration, Washington, D.C.

[22] Filed: Sept. 24, 1974

[21] Appl. No.: 508,940

[44] Published under the second Trial Voluntary Protest Program on February 17, 1976 as document No. B 508,940.

[52] U.S. Cl. ..... 137/255; 123/139 AW; 244/135 C

[51] Int. Cl.[2] ..... F02M 37/00

[58] Field of Search..... 137/255, 259, 368; 123/136, 139 AW, 139 AF; 244/135 R, 135 C

[56] References Cited

UNITED STATES PATENTS

| | | | |
|---|---|---|---|
| 731,918 | 6/1903 | Landers | 137/255 X |
| 811,749 | 2/1906 | Somers | 137/268 |
| 1,776,877 | 9/1930 | Yonkese | 244/135 C |
| 2,519,968 | 8/1950 | Jordan | 244/135 C |
| 2,573,299 | 10/1951 | Bast | 137/268 |
| 2,773,556 | 12/1956 | Meyers et al. | 137/255 X |
| 2,901,031 | 8/1959 | Powell et al. | 123/139 AW |
| 3,026,928 | 3/1962 | Phillips et al. | 123/139 AW |
| 3,771,504 | 11/1973 | Woods | 123/139 AW |
| 3,789,819 | 2/1974 | Moulds | 123/139 AW |

FOREIGN PATENTS OR APPLICATIONS

| | | | |
|---|---|---|---|
| 44-25685 | 1/1969 | Japan | 137/255 |
| 98,679 | 7/1921 | Switzerland | 137/255 |

*Primary Examiner*—Martin P. Schwadron
*Assistant Examiner*—Robert J. Miller
*Attorney, Agent, or Firm*—Dean E. Carlson; Dudley W. King; Ignacio Resendez

[57] ABSTRACT

A vehicle fuel system comprising a plurality of tanks, each tank having a feed and a return conduit extending into a lower portion thereof, the several feed conduits joined to form one supply conduit feeding fuel to a supply pump and using means, unused fuel being returned via a return conduit which branches off to the several return conduits.

4 Claims, 4 Drawing Figures

VEHICLE FUEL SYSTEM

BACKGROUND OF INVENTION

The invention relates to a vehicle fuel system.

Prior art systems and methods for removing fuel from a plurality of supply tanks often pumped the liquid from one tank and employed interconnecting piping or crossover lines coupled to the bottom walls of the supply tanks to provide flow of fluid between the tanks. These crossover lines were generally the lowest parts on a vehicle since flow between tanks depended upon gravitational forces, and were generally susceptible to accidental rupture since they were exposed to debris, stones, etc., on roads. Their exposed location also increased the susceptibility to rupture in accident situations. This susceptibility to accidental rupture created a generally unsafe condition, especially when the supply tanks were fuel tanks on a truck, tractor or other vehicles.

In an effort to resolve the above problem, some systems required one tank to be emptied and then a valve activated to start using the other fuel tank. Drawbacks to this system were that they involved additional expensive mechanical parts, such as valves, subject to breakdown. Further, prior art systems did not provide or control the feed and return of fuel to equalize the liquid level in the separate supply tanks.

SUMMARY OF INVENTION

In view of the above, it is an object of this invention to provide an inexpensive, simple vehicle fuel system which eliminates the need for the crossover lines described above.

It is a further object of this invention to provide a vehicle fuel system useful for high compression engines such as diesel engines and other internal combustion engines.

It is a further object of this invention to provide a simple vehicle fuel system for maintaining liquid levels about equal in a plurality of tanks as liquid is withdrawn from and returned to these tanks.

Various other objects and advantages will appear from the following description of the invention and the most novel features will be pointed out hereinafter in connection with the appended claims. It will be understood that various changes in the details and structure of the embodiment herein described in order to explain the nature of the invention may be made by those skilled in the art without departing from the principles and scope of this invention.

The invention comprises a vehicle fuel system comprising a plurality of supply tanks, each tank containing a feed and a return conduit extending to a bottom portion thereof; the several feed conduits each of about equal length and inner diameter joined to form one supply conduit for feeding fuel to a supply pump and a using means, unused fuel being returned to the tank via a return conduit which branches off to the several return conduits which are of about equal length and inner diameter.

DETAILED DESCRIPTION

Figure 1:
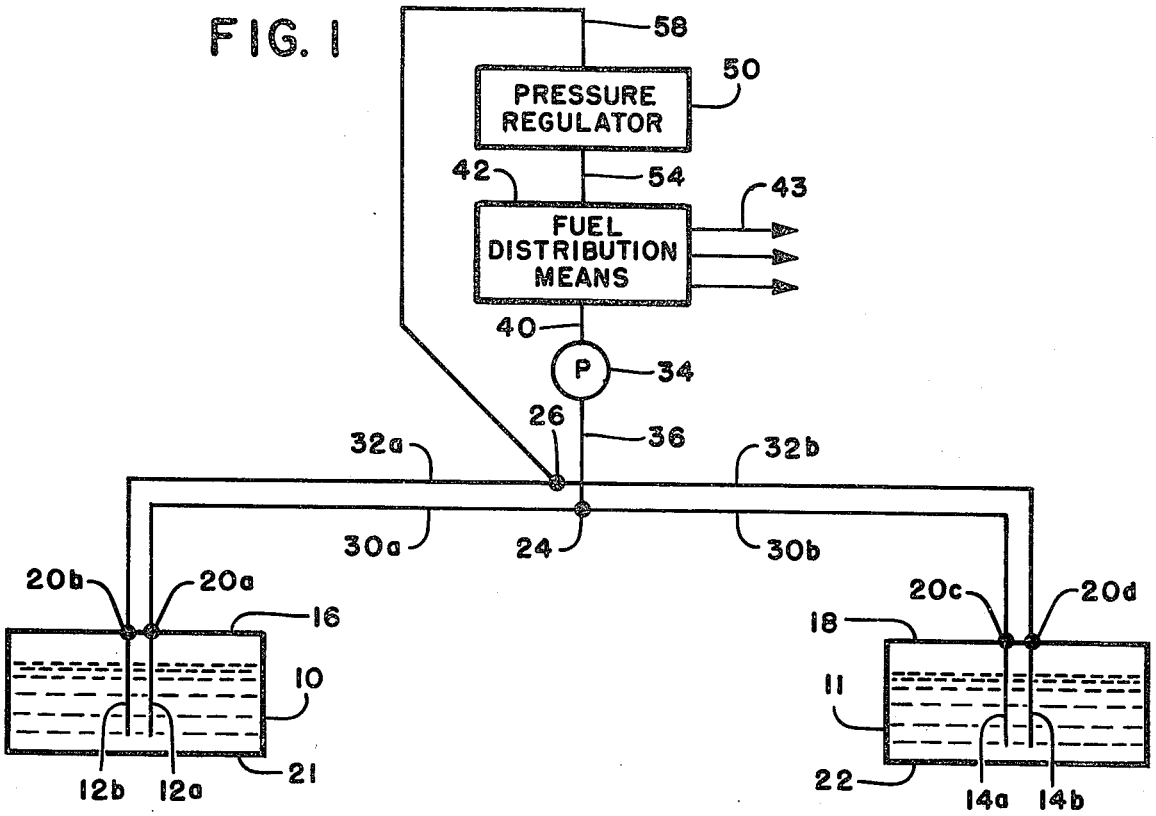
FIG. 1 is a schematic illustration of a system according to the present invention.

As shown in the drawing, the vehicle fuel system may include, for purpose of illustration, a pair of containers or supply tanks 10, 11 with each tank containing a pair of open ended pipes or conduits 12*a*, 12*b*, 14*a*, 14*b* which are connected or coupled to an upper portion of tanks 10, 11, such as through top walls 16, 18 respectively, by appropriate couplings or fittings 20*a*, 20*b*, 20*c*, 20*d*. These fittings may be of conventional type which provide a good mechanical connection and a tight seal or, in an alternate embodiment, the pipes may be welded or otherwise joined to upper portions of each tank, such as to walls 16, 18. Pipes 12*a*, 12*b*, 14*a*, 14*b* extend to a lower portion of the interior of each supply tank 10, 11 and have an open end thereof suitably spaced from and adjacent the lower wall 21, 22 of tanks 10, 11 respectively. For example, the pipe end may be spaced about one inch from the lower wall. This spacing is desirable in order to prevent undesired particulate or other foreign material from entering the supply feed lines. The pipes in each tank are of approximately equal length and inner diameter and preferably have their bottom openings at about the same level. The tanks are at about the same height and are provided with suitable vent means which vent the tanks to an equal pressure source such as atmosphere pressure.

Disposed outside tanks 10, 11 and above the tanks are a pair of conduit couplings, connectors, 24, 26 or the like. The couplings in the illustration provided may be tee joints, i.e., short pieces of pipe each having a lateral outlet, or the like although it is to be understood that if additional supply tanks are added, the couplings will assume different shapes or configurations to accommodate the added conduits. A pair of liquid supply conduits, piping or tubing branches or legs 30*a*, 30*b* are connected between tank 10, 11 fittings 20*a*, 20*c* respectively and coupling 24 as shown. Supply conduits 30*a*, 30*b* should be of approximately equal length and inner diameter such that the length of branch 30*a* between coupling 24 and connection or fitting 20*a* is about equal to the length of branch 30*b* disposed or located between coupling 24 and fitting 20*c*. Liquid return conduits, branches or legs 32*a*, 32*b* are likewise connected between the remaining connections or fittings 20*b*, 20*d* respectively of each supply tank and the remaining conduit coupling 26, as shown. These conduits should also be of approximately equal length and inner diameter such that the length of branch 32*a* between coupling 26 and fitting 20*b* is about equal to the length of branch 32*b* between coupling 26 and fitting 20*d*. It is readily understood that both the supply conduits 30*a*, 30*b* and pipes 12*a*, 14*a* may be made from one section passing through an upper wall portion of the supply tanks 10, 11 respectively. Conduits 32*a*, 32*b* and pipes 12*b*, 14*b* may likewise be formed from one section passing through an upper wall portion of tanks 10, 11 respectively.

The supply branches or conduits 30*a*, 30*b* should each provide about the same fuel flow restriction in order to advantageously utilize the effect of pressure differentials created by different liquid levels in the supply tanks. The return conduits or branches 32*a*, 32*b* should likewise provide about the same fuel flow restriction for the same reason. Equal fuel flow restriction is readily provided by maintaining the inner diameters and lengths of the supply branches 30*a*, 30*b* about equal and of the return branches 32*a*, 32*b* about equal. Of course, one skilled in the art is aware that sharp bends in the conduits, unequal heights of the various conduits, etc., are factors which affect liquid flow characteristics and, if present in the fuel system of the invention, might result in unequal fuel flow restriction in the supply branches or the return branches. These factors are then to be avoided unless incorporated in each branch to provide a generally symmetrical configuration about the coupling 24, 26 or unless otherwise compensated to result in equal fuel flow restrictions in the supply branches or in the return branches.

A supply pump 34 may be provided to remove or pump liquid from supply tanks 10, 11 through liquid supply conduit 36 which interconnects supply pump 34 through coupling 24 to the supply tanks. Of course, it is possible to interconnect or couple, if desirable, conduits 30*a*, 30*b* directly to supply pump 34 and thus eliminate coupling 24. Liquid is passed by pump 34 through conduit 40 to fuel distribution means 42 such as an injection pump, carburetor or the like and thereafter distributed, as indicated by arrows 43, to a suitable utilization means (not shown) which may be a suitable high compression engine such as a diesel engine or other internal combustion engine. Fuel distribution means 42 may use only a portion of the liquid supply. Excess or unused liquid may be transferred to pressure regulator 50 through conduit 54 as shown. Pressure regulator 50 should maintain a back pressure on the fuel within conduit 54 and fuel distribution means 42, and may be such as a restriction or constriction within conduit 54. Excess liquid passes through pressure regulator 50 to supply tanks 10, 11 through liquid removal conduit or main fuel return 58 which interconnects pressure regulator 50 and coupling 26, and thereafter through liquid return legs 32*a*, 32*b* to supply tanks 10, 11 respectively.

Figure 4:
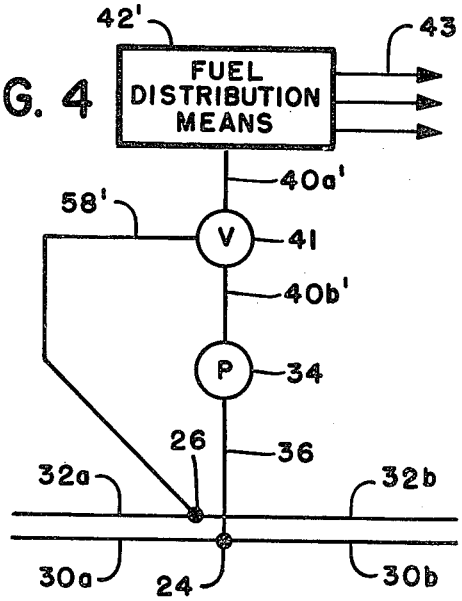

Although an engine is described herein as the using means, it should be obvious that the subject matter of this invention would also have application where any liquid is to be withdrawn from a plurality of tanks and it is desired to keep the liquid level in the tanks about equal. Further, although FIG. 1 schematically illustrates a configuration employing a line extending from a pressure regulator to coupling 26, it would be within the scope of this invention to eliminate or otherwise deadhead, plug, or close conduit 54 to create a back pressure which could be relieved by the use of suitable vent means 41 (as shown at Fig. 4) between pump 34 and fuel distribution means 42′ and interconnected thereto by conduits 40*a′* and 40*b′* respectively, which vent means 41 could then be interconnected to coupling 26 through such as conduit 58′.

Although only two supply tanks and the corresponding supply and return conduits are illustrated, it should be obvious that additional supply tanks or containers may be employed merely by altering the configuration of the couplings 24, 26 and providing additional conduits from the supply tanks to these couplings. The tanks should be at about the same height since it is the liquid level that is maintained about equal. If one tank is placed or located at a greater height than other tanks, this tank will have a lower liquid level while the others may be overflowing. Further, FIG. 1 illustrates very broadly a schematic of a fuel apparatus arrangement for use in such as diesels or other engines. This schematic could be expanded to include various apparatuses, such as venting means, bypass valves, etc., but as presented is believed sufficiently detailed to be readily understood in all its applications by one skilled in the art.

The liquid level equalizing fuel system of this invention is particularly adaptable for tractor trailers and trucks which employ two or more fuel tanks since it makes possible the larger or preponderant use of fuel from the tank having a higher fuel level and the return of unused fuel to the tank having the lower fuel level. This prevents the use of fuel from only one tank and the return of fuel to the other tank which might otherwise overflow the other tank and create an unsafe condition, as well as doing away with the need for crossover lines beneath the fuel tanks. Fuel is supplied to the supply pump 34 through liquid supply legs 30*a*, 30*b* and the corresponding couplings, fittings and pipes as discussed above. Fuel is returned to the fuel tanks through liquid return branches 32*a*, 32*b* and the corresponding couplings, fittings and pipes again as discussed above. The supply lines and return lines may be arranged, configured or designed to give generally symmetrical flow paths around the couplings thereby assuring that the pressure differences due to fuel flow restrictions are small compared to static heads in the pipes within the tanks.

Figure 2:
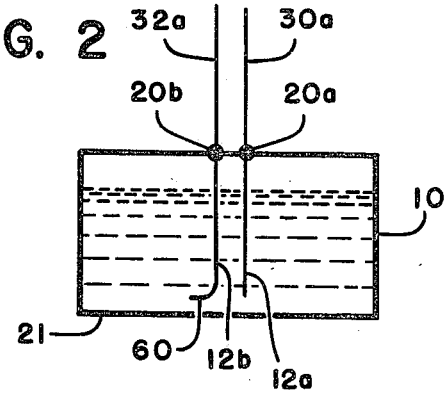
FIG. 2 schematically illustrates an alternate conduit configuration within a supply tank.

The return branches 32*a*, 32*b* are attached to fittings 20*b*, 20*d* that extend to a point adjacent the bottom wall 21, 22 of the fuel tanks 10, 11 respectively, and discharge the fuel being returned at the bottom of the tanks. As shown in FIG. 2, the ends of return pipes, such as pipe 12*b*, may contain a radius or curved portion 60 which directs the return stream away from the liquid supply pipe 12*a*, such that there is greater turbulence or mixing of the fuel within the tanks and less possibility of supplying heated return fuel to the engine.

Figure 3:
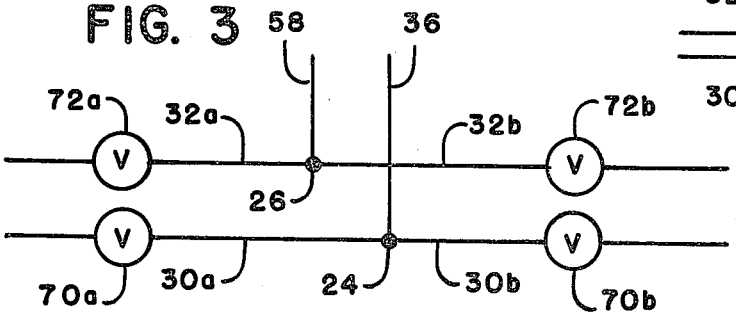
FIG. 3 schematically illustrates a valve arrangement within the supply and return conduits, and FIG. 4 schematically illustrates an alternate main return conduit configuration.

It may be desirable to be able to use fuel from and return fuel to only one supply tank at certain times such as when one fuel tank ruptures or the fuel in one tank becomes contaminated, or when there is to be a substantial amount of vehicle movement along sides of hills or mountains having a steep grade. Since this invention relies on pressure differentials and gravity forces to maintain the liquid levels about equal, it is readily understandable that hillside running may maintain one tank at a lower level than the other for significant periods of time. This may create overflow problems since the return fuel will be directed to the tank which is at a lower level. Although it is not anticipated that this problem will be encountered in ordinary highway conditions, it may be easily resolved when encountered by locating appropriate closing means such as valves 70*a*, 70*b*, 72*a*, 72*b* on supply and return conduits 30*a*, 30*b*, 32*a*, 32*b* respectively, as illustrated in FIG. 3. These valves may be remotely controlled if desired as known in the art. Closure of valves 70*a*, 72*a* or 70*b*, 72*b* permits the selective use of one supply tank until the vehicle is operating on more level terrain or until a damaged tank may be repaired.

An example of the operation of this apparatus follows. If the fuel level in tank 10 is lower than the fuel level in tank 11, greater differential pressures resulting from the differences in liquid level heights or static heads will exist between the fuel level in tank 10 and the couplings 24, 26 and the fuel level in fuel tank 11 and the couplings 24, 26. The pressure differentials in the liquid supply branch 30*a* and liquid supply branch 30*b* result in a greater flow from the tank having the higher fuel level (tank 11) to supply pump 34 and thus tend to bring the fuel in both tanks to the same level. The pressure differentials in the liquid return legs, 32*a*, 32*b* result in a greater return flow to the low tank (tank 10) because of the higher pressure differential and thus further tend to bring the fuel in both tanks to the same level. Thus the pressure differentials work to maintain a constant or equal level in both tanks at all times, and would be equally applicable to an apparatus having more than two tanks, as long as the liquid return branches were of about equal length and about equal conduit diameter, i.e., provided about equal fuel flow restriction, and the liquid supply branches were also of about equal length and about equal conduit diameter, i.e., provided about equal fuel flow restriction.

This liquid level equalizing vehicle fuel system has been employed in several vehicles and has provided very satisfactory results in operation. The conduits, couplings, etc., used in this system are located above the level of the fuel tanks as described herein and generally above the frame structure of the vehicles. These conduits are not exposed to road hazards such as rocks or debris lying on roads, and give added protection in accident situations to therefore provide greater safety against accidental rupture and fire.

What we claim is:

1. A self-regulating fuel level equalizing system for internal combustion engines of vehicles comprising a plurality of spaced apart fuel tanks, feed conduits having about equal length, about equal inner diameter, and about equal fuel flow restriction and having lower portions with open ends each disposed at about the same level for automatic preferential fuel withdrawal from the fuller of said tanks, housed within and extending from lower portions of each of said tanks through an upper portion of each of said tanks and devoid of external bottom connections with said tanks and each coupled to a fuel pump, a fuel pump for preferentially withdrawing fuel from the fuller of said tanks through said feed conduits and supplying at least a portion of said fuel to a said engine, distribution means for feeding said fuel from said fuel pump to said engine, return conduits separate from said feed conduits having about equal length, about equal inner diameter, and about equal fuel flow restriction, and having lower portions with open ends each disposed at about the same level in said tanks for automatic preferential fuel return to the less full of said tanks, housed within and extending from lower portions of each of said tanks through and upper portion of each of said tanks and coupled to said fuel pump for preferentially returning any unused portion of said withdrawn fuel to the less full of said tanks, said preferential fuel withdrawing and returning automatically coacting to maintain an about equal fuel level in said fuel tanks.

2. The system of claim 1 further including a feed conduit coupling intermediate said fuel pump and said fuel tanks, each of said feed conduits coupled to said feed conduit coupling, and a supply conduit interconnecting said fuel pump and said feed conduit coupling for passing fuel to said fuel pump.

3. The system of claim 2 further including a return conduit coupling intermediate said distribution means and said fuel tanks, each of said return conduits coupled to said return conduit coupling, and a main return conduit interconnecting said distribution means and said return conduit coupling for returning unused fuel to said return conduit coupling and thereafter to said fuel tanks.

4. The system of claim 1 wherein said return conduits are each provided with a curved portion adjacent bottom walls of the tanks directed away from ends of said feed conduits.

* * * * *